United States Patent [19]

Caston

[11] 4,350,249

[45] Sep. 21, 1982

[54] VISUAL FILING SYSTEM FOR GEMS, JEWELRY ITEMS, SMALL PARTS AND THE LIKE

[76] Inventor: Alfred W. H. Caston, 90-17 Francis Lewis Blvd., Queens Village, N.Y. 11428

[21] Appl. No.: 211,660

[22] Filed: Dec. 1, 1980

[51] Int. Cl.[3] ..... B65D 1/34

[52] U.S. Cl. ..... 206/566; 206/466; 206/486; 206/523; 206/589

[58] Field of Search ..... 206/466, 486, 488, 558–566, 206/523, 589

[56] References Cited

U.S. PATENT DOCUMENTS

| | | | |
|---|---|---|---|
| 480,045 | 8/1892 | Sommer | 206/562 X |
| 1,278,354 | 9/1918 | Kendis | 206/566 X |
| 1,305,241 | 5/1919 | Hendry | 206/566 X |
| 1,527,719 | 2/1925 | Wetherell | 206/566 X |
| 1,956,205 | 4/1934 | Scruggs | 206/566 |
| 2,030,966 | 2/1936 | Lustig | 206/466 |
| 2,540,969 | 2/1951 | Tylon | 206/566 |
| 2,883,048 | 4/1959 | Lentz | 206/562 |
| 3,029,939 | 4/1962 | Feldman | 206/466 |
| 4,084,720 | 4/1978 | Thurston | 206/566 X |
| 4,120,401 | 10/1978 | Newman | 206/566 |

FOREIGN PATENT DOCUMENTS

| | | | |
|---|---|---|---|
| 1270424 | 7/1961 | France | 206/566 |
| 528542 | 6/1955 | Italy | 206/566 |
| 1492741 | 11/1977 | United Kingdom | 206/466 |

*Primary Examiner*—William Price
*Assistant Examiner*—Gary E. Elkins
*Attorney, Agent, or Firm*—Richard L. Miller

[57] ABSTRACT

A tray having a plurality of slots is provided so that a plurality of flexible plastic holders for gems and the like may be inserted into the slots for safe keeping and for visual display.

6 Claims, 3 Drawing Figures

VISUAL FILING SYSTEM FOR GEMS, JEWELRY ITEMS, SMALL PARTS AND THE LIKE

BACKGROUND OF THE INVENTION

It is often required that precious gems, jewelry, small parts, and the like need to be kept in a safe place where they may be prevented from scattering, and still be displayed for inspection. Without a means for holding and displaying the gems and the like, there is a greater risk of material loss due to dropping the articles and not being able to find them again. Combined with this is the need to have these articles always on display, as for a prospective customer in the case of a merchandiser, or as for a watch repairman to see the part he is in need of, and other similar circumstances where both the need for visual display is combined with the need for safe and protected keeping.

SUMMARY OF THE INVENTION

It is, therefore, the primary object of the present invention to provide a tray with a plurality of slots that may hold in a secure fashion a plurality of holders that allow for the gems or other articles contained therein to be seen.

The tray of the present invention is made of a first upper layer of cardboard, a middle layer of a flexible material such as sponge rubber, and a third layer made up of a pair of adhered cardboard sheets. All three layers are bonded together and surrounded by a metal frame for stability and strength. The plurality of slots are formed in the top cardboard layer and the middle flexible layer, whereby when the plastic holder for the gems and the like are inserted therein, the flexible material of the middle layer will grip the holders and secure them therein.

The flexible plastic holders each have an open end and a closed end. The open end has a pressure sensitive closure for sealing the open end after the gems or the like have been inserted therein for storage and display in the slots of the tray. The pressure sensitive closure is also used as a tag upon which is written a code for inventory purposes to keep track of the types of gems and the like in any particular holder and the amount thereof. The pressure sensitive closure may be of the permanent type that must be ripped open after sealing, or the reusable type that may be reused repeatedly. A dust cover of a clear plastic may also be provided for the tray. The bottom cardboard sheets may also be die-punched to form an easel.

Further objects of the invention will appear as the description proceeds.

To the accomplishment of the above and related objects, this invention may be embodied in the form illustrated in the accompany drawings, attention being called to the fact, however, that the drawings are illustrative only, and that changes may be made in the specific construction illustrated and described within the scope of the appended claims.

BRIEF DESCRIPTION OF THE DRAWINGS

The invention will be more readily understood with reference to the accompanying drawing, wherein.

DETAILED DESCRIPTION OF THE INVENTION

Figure 2:
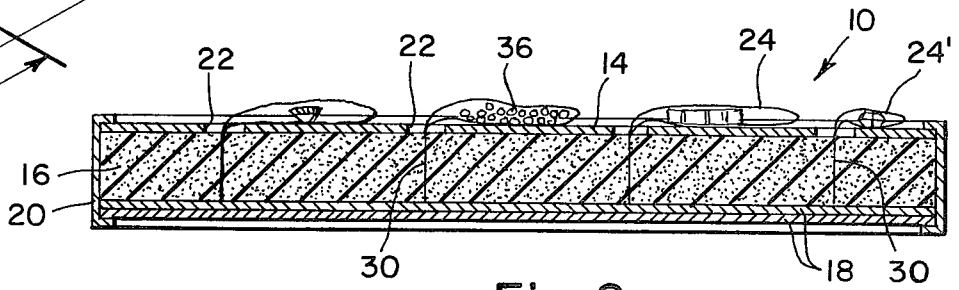
FIG. 2 is a cross-sectional view taken along line 2—2 of FIG. 1.
Figure 1:
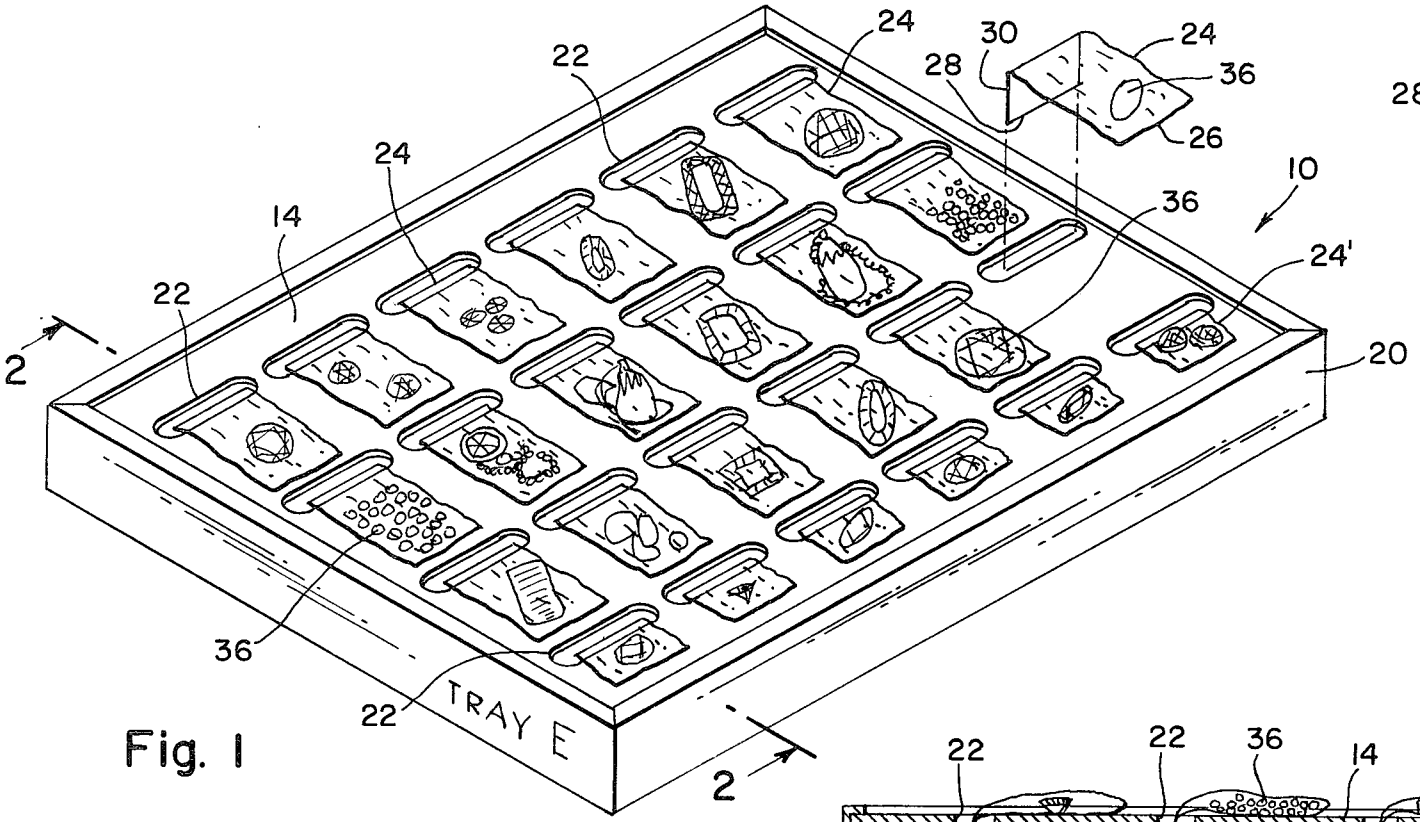
FIG. 1 is a perspective view of the filing system of the present invention.

Referring now to the drawing, the visual filing system 10 of the present invention is shown in FIG. 1. The filing system 10 is made up of a tray E formed of three layers. The first top layer 14 is made of a cardboard sheet; the second middle layer 16 is made of a resilient material such as sponge rubber; and a third bottom layer 18 is made of two cardboard sheets adhered together. The three layers are adhered together by an appropriate adhesive or bonding means, such as epoxy or the like. A metal frame 20 surrounds the perimeters of all three layers as can be seen in FIGS. 1 and 2.

Formed in the top cardboard layer 14 are a plurality of slots 22, with the middle resilient layer 16 also having corresponding slots situated directly beneath the slots of the cardboard layer 14. The slots in the middle resilient layer 16 preferably extend the full depth of the layer so that a greater force is exerted upon the elements inserted therein to thereby grip in place the holders to be described below.

Figure 3:
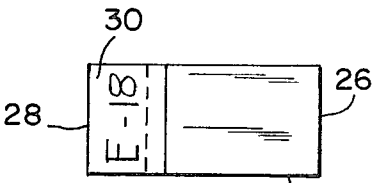
FIG. 3 is a plan view of the plastic holder of the filing system of the present invention.

The filing system of the present invention utilizes a plurality of holders 24 formed of a flexible plastic material such as cellophane. Each holder, as can be seen in FIG. 3, has a closed end 26 and an open end 28, with a pressure sensitive closure 30 formed at the open end for sealing off the holder after there has been placed therein gems, jewelry, and the like 36 which is to be displayed and stored in the slots 22 of the tray E. Typically, the plastic holder 24 is 1½ inches in length, with the pressure sensitive closure extending for about ½ inch along the length. The width is typically ¾ inch, which is also the length of each slot 22 formed in the tray E, so that there is snug fit when the holder 24 is inserted into a slot 22. The holder 24 is inserted into the slot 22 via the pressure sensitive end after the open end has been sealed by the pressure sensitive closure, as can be seen in FIG. 2. The holders may be made such that they are folded in a double manner, as 24' of FIG. 1, to make a tighter insertion in the respective slot 22.

The pressure sensitive closure 30 is also used as an inventory tag upon which may be written a code number, such as "E-18" as shown in FIG. 3. This code number is for inventory purposes, which will indicate the amount of gems or the like in the holder and the type of gem, or the like.

As can be seen in FIG. 1, numerous types of gems, jewelry, and the like may be stored in the holders 24 and placed in the tray E for safe and secure keeping and display. The filing system of the present invention also has uses in storing beads, coins, parts for watches, and a host of other applications.

The filing system of the present invention is easy to use and provides safety against the loss of the gems, jewelry, and small parts that otherwise would be lost if dropped.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A visual filing system for gems and the like comprising, in combination:

a tray having a top layer of substantially rigid material, a bottom layer of substantially rigid material, and a middle layer of resilient material adhered to each of said top and bottom layers, and a plurality of flexible plastic holding tubes for holding and sealing therein gems, jewelry and the like in locked and protective fashion whereby said gems and the like are prevented from escaping said plastic holding tubes, each of said holding tubes having one closed end and one open end, said top and middle layers forming a plurality of slots for removably receiving said open end of said holding tubes.

2. The visual filing system according to claim 1, further including means at said open end of each said holding tube for closing said open end to prevent said gems and the like enclosed therein from escaping.

3. The visual filing system according to claim 2, wherein each of said plurality of holding tubes includes a tag for coding thereon.

4. The visual filing system according to claim 3, wherein said tray further includes a frame of metal for supporting said top and bottom surfaces, said frame enclosing said surfaces about the perimeters thereof.

5. The visual filing system according to claim 4, wherein said resilient material is sponge rubber and said metal frame overlaps said sponge rubber about the sides thereof.

6. The visual filing system according to claim 5, wherein said substantially rigid material is cardboard.

* * * * *